US005673760A

United States Patent [19]

Brooks et al.

[11] Patent Number: 5,673,760

[45] Date of Patent: Oct. 7, 1997

[54] PERFORATING GUN INCLUDING A UNIQUE HIGH SHOT DENSITY PACKING ARRANGEMENT

[75] Inventors: James Emmert Brooks, Manvel; Jack Fergurson Lands, West Columbia; Gary Mack Lendermon, Missouri City; Jorge Enrigue Lopez de Cardenas, Sugar Land; Robert Al Parrott, Houston, all of Tex.

[73] Assignee: Schlumberger Technology Corporation, Houston, Tex.

[21] Appl. No.: 556,243

[22] Filed: Nov. 9, 1995

[51] Int. Cl.[6] ..... E21B 43/117

[52] U.S. Cl. ..... 175/4.6; 166/298

[58] Field of Search ..... 175/4.6; 166/297, 166/298

[56] References Cited

U.S. PATENT DOCUMENTS 4,773,299 9/1988 Oestreich et al. ..... 175/4.6 X 4,960,171 10/1990 Parrott et al. .

*Primary Examiner*—William P. Neuder

*Attorney, Agent, or Firm*—Gordon G. Waggett; John H. Bouchard; John J. Ryberg

[57] ABSTRACT

A perforating gun includes a multiplicity of shaped charges, the multiplicity of shaped charges including a plurality of planes of charges, each plane of charges including a plurality (N) of shaped charges and a detonating cord running down through the axial center of each of the plurality of planes of charges. The plurality (N) of shaped charges are equally spaced at an angle 360/N about the detonating cord. The plurality of planes of charges: (1) are rotated at an angle of 180/N relative to one another, and (2) are axially packed together along the longitudinal axis of the gun so that the charges in one plane are nearly touching the charges in the adjacent plane, yet they all share the same centered detonating cord. The proximity of one plane to another is close enough such that one plane of charges detonates within a few microseconds of its neighboring plane of charges. The close packing of the shaped charges in the same plane and between adjacent planes: (1) prevent the charge cases from expanding significantly upon detonation, and (2) prevent the charge cases from breaking up into numerous small pieces (large chunks of charge case debris results). A near-maximum packing density for a given cylindrical gun volume produces two unexpected properties: (1) a reduced swelling of the gun's diameter after detonation because of the combination of the near maximum packing density and symmetric detonation of the shaped charges; and (2) a significant reduction in the amount of shaped charge case debris that can escape from the perforating gun.

8 Claims, 3 Drawing Sheets

FIG. 2
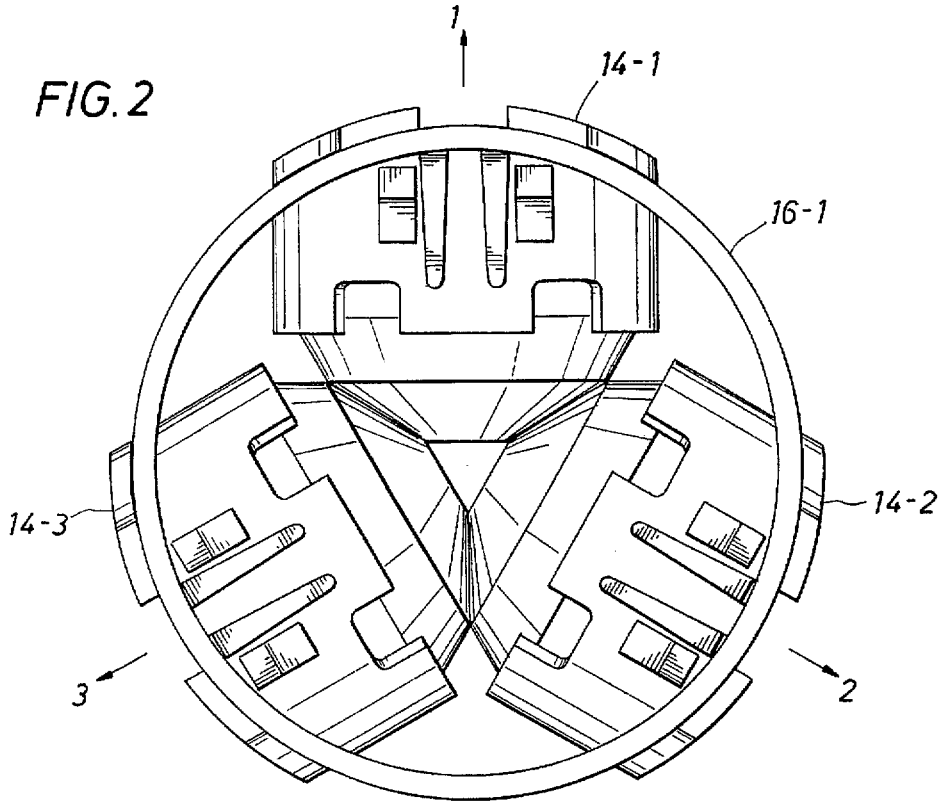
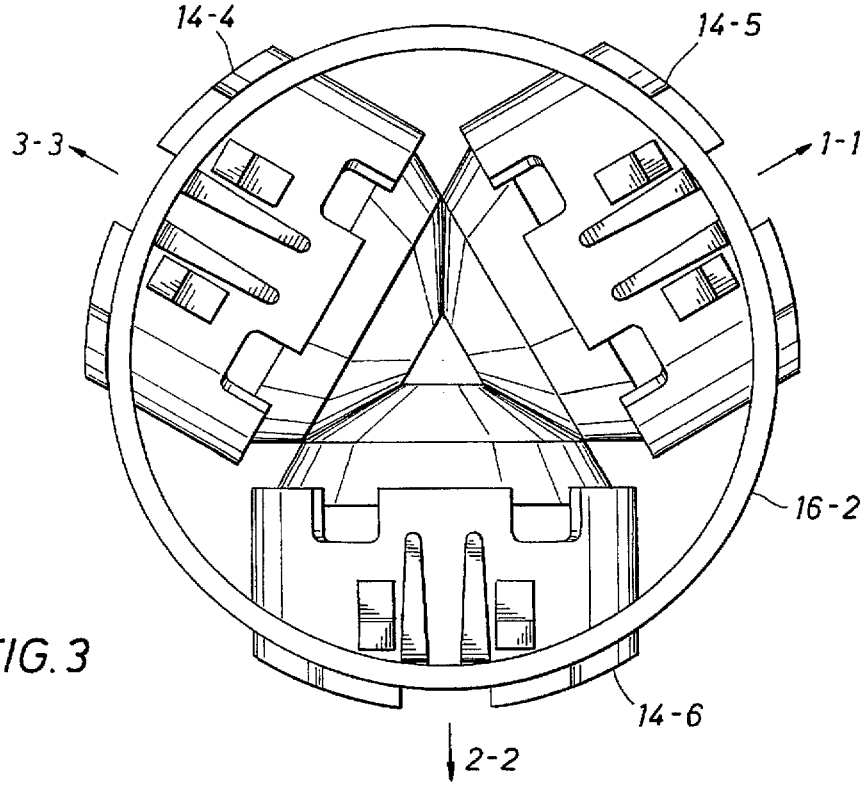
FIG. 3

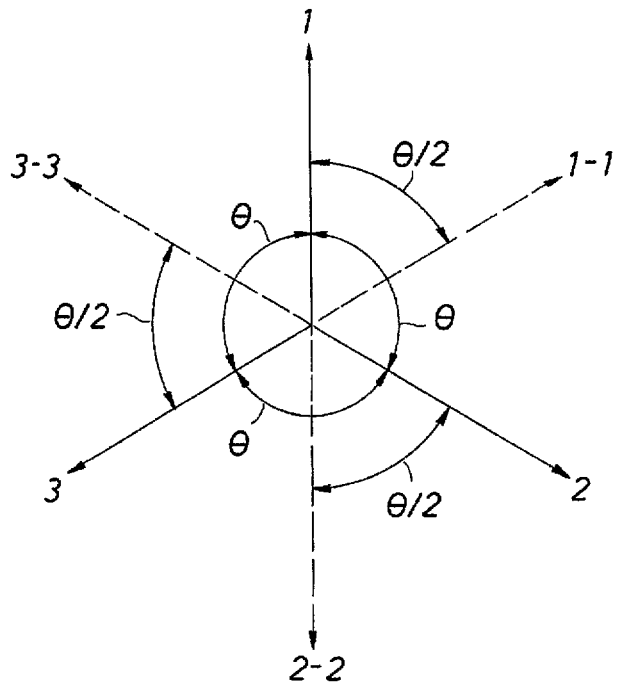
FIG. 4
FIG. 5
(PRIOR ART)
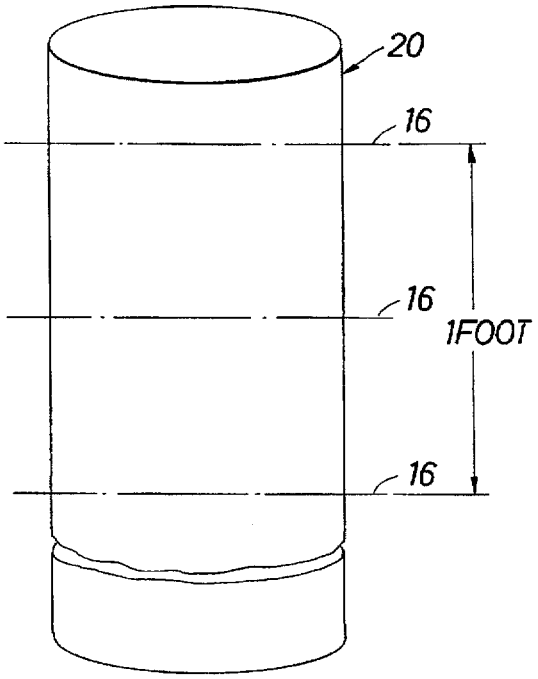
FIG. 6
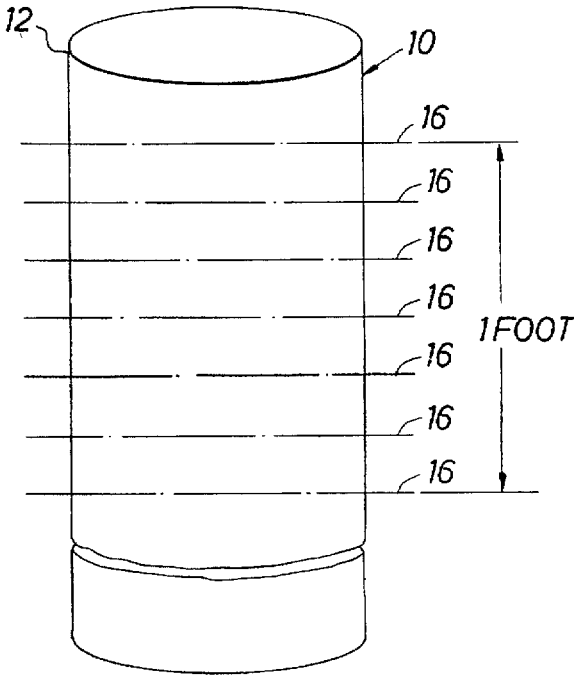

PERFORATING GUN INCLUDING A UNIQUE HIGH SHOT DENSITY PACKING ARRANGEMENT

BACKGROUND OF THE INVENTION

The subject matter of the present invention relates to a perforating gun adapted to be disposed in a wellbore, and more particularly, to a unique method and associated apparatus for packing a plurality of shaped charges in the perforating gun for the purpose of increasing the shot density of the charges in the gun while, simultaneously, limiting the large quantities of shaped charge debris formed following detonation of the gun and limiting the swelling of the perforating gun which normally occurs during detonation of the gun.

A perforating gun, including a plurality of shaped charges, is disposed in a wellbore. The shaped charges will detonate when a detonation wave propagates along a detonating cord, the detonation wave initiating the detonation of the plurality of charges in the loading tube of the perforating gun. During the detonation of the shaped charges, the diameter of the perforating gun normally increases. This increase in diameter is caused primarily by shaped charge debris and explosive gases formed inside the loading tube during detonation of the perforating gun. When the shaped charges in the perforating gun detonate, the resultant shaped charge shrapnel or debris, formed during the detonation of the shaped charges, will impact the inside of the perforating gun and, in addition, the explosive gases, formed during detonation of the charges, will increase in density and pressure inside the gun. The impact of the shaped charge debris against the inside of the perforating gun and the increased pressure of the explosive gases inside the gun will cause the diameter of the perforating gun to increase or swell.

For example, there are two common arrangements used by the prior art perforating gun. In a first prior art arrangement, there is only one shaped charge in each cylindrical plane. In a typical configuration of this type, the back end of the charge is often positioned across the centerline of the gun. In a second prior an arrangement, there are three shaped charges in each cylindrical plane and a detonating cord runs through the axial center of the gun. In both the first and the second prior an arrangement, the spacing between the charges is relatively large and, as a result, the shaped charge case is able to expand when the shaped charges detonate. Expansion of the shaped charge case will result in a breakup of the case thereby producing small pieces of shrapnel that impact the inside wall of the perforating gun and deform and swell the gun.

If the swelling (and resultant increased diameter) of the perforating gun is too large, it will be difficult if not impossible to retrieve the detonated perforating gun from the wellbore because the swelling of the gun, and its resultant increased diameter, will not allow an operator at the wellbore surface to remove the detonated perforating gun from the casing or tubing in the wellbore. Consequently, in order to limit the swelling of the perforating gun loading tube during detonation, it was necessary to limit the shot density and/or the size of the shaped charges of the prior art perforating gun to a predetermined amount. That is, the prior art perforating gun could not have a shot density that was higher than the predetermined amount.

However, it is nevertheless desirable to increase the shot density of the prior art perforating gun beyond the predetermined amount in order to increase the production of the wellbore being perforated by the perforating gun.

SUMMARY OF THE INVENTION

Accordingly, it is a primary object of the present invention to provide a perforating gun having a shot density which is greater than the shot density of the prior art perforating gun and which, when detonated, will reduce the swell and thereby increase the diameter of the perforating gun.

It is a further object of the present invention to provide a perforating gun which has a shot density that is greater than the shot density of prior art perforating guns, will not swell in diameter in a manner which was typical of prior art perforating guns, and will leave in the wellbore a lower quantity of shaped charge debris following detonation than the quantity of shaped charge debris left by the prior art perforating guns.

It is a further object of the present invention to provide a perforating gun which includes a plurality of transversely disposed planes separated by a predetermined distance, each plane including a plurality of shaped charges where each shaped charge produces a shot when detonated, the number of planes per foot and therefore the number of shots per foot representing a shot density for the perforating gun, the charges in each plane being rotated clockwise by an angle equal to half the phase angle between the charges in a previous adjacent plane and a predetermined distance between each of the adjacent planes being minimized and carefully selected such that the shot density of the perforating gun is maximized and the free volume in the gun is minimized, the charges in one plane are nearly touching the charges in an adjacent plane, the perforating gun will not swell in diameter in a manner which is typical of prior art perforating guns, the plurality of shaped charges in the plurality of planes detonate approximately simultaneously, and the perforating gun will produce a lower quantity of shaped charge debris following detonation than the quantity of shaped charge debris produced by the prior art perforating guns.

In accordance with these and other objects of the present invention, a preferred embodiment of the perforating gun of the present invention includes a multiplicity of shaped charges, the multiplicity of shaped charges including a plurality of planes of charges, each plane of charges including a plurality (N) of shaped charges and a detonating cord running down through the axial center of each of the plurality of planes of charges. The plurality (N) of the shaped charges are equally spaced at an angle 360/N about the detonating cord. Therefore, all of the shaped charges lying within each plane detonate at approximately the same time. In addition, the plurality of planes of charges: (1) are rotated at an angle of 180/N relative to one another, and (2) are packed so that the charges in one plane are nearly touching the charges in the adjacent plane, yet they all share the same centered detonating cord. The proximity of one plane to another is close enough such that one plane of charges detonates within a few microseconds of its neighboring plane of charges. The free space which exists between neighboring charges in the same plane and between neighboring charges on adjacent planes is nearly the same and, in both cases, such free space is very small. The close packing of the shaped charges in the same plane and between adjacent planes, and the resultant nearly simultaneous detonation of all the charges in the perforating gun: (1) prevent the charge cases from expanding significantly upon detonation, and (2) thereby prevent the charge cases from breaking up into numerous small pieces. As a result, the preferred embodiment of the perforating gun of the present invention yields a near-maximum packing density for a given cylindrical gun volume and gives rise to the following two unexpected properties:

(1) A reduced swelling of the gun's diameter after detonation because of the combination of near maximum packing density and symmetric detonation of the shaped charges—The close packing of the charges and near-simultaneous detonation prevents most of the charge case shrapnel from reaching the gun's inside wall, thereby decreasing the pressure loading that normally accompanies the detonation of a shaped charge. Rather than impacting the gun wall, most of the shrapnel impacts harmlessly on adjacent shaped charges.

(2) A significant reduction in the amount of shaped charge case debris that can escape from the perforating gun—The shaped charge case debris tends to get trapped in place, preventing the debris from expanding and subsequently breaking up into small particle debris. Most of the resulting debris is too large to escape from the exit holes in the perforating gun.

Another embodiment of the present invention would involve the placement of a filler between shaped charges to affect the same result. The filler acts to prevent the shaped charge case from breaking up into small pieces of shrapnel upon detonation, thus reducing the pressure loading on the inside surface of the gun. As a result, large pieces of shaped charge case debris is produced following detonation of the shaped charges.

The novel perforating gun of the present invention is designed in a manner which will provide a higher shot density than the shot density of prior art perforating guns. In the preferred embodiment given by way of example only, the perforating gun of the present invention includes a plurality of planes of shaped charges, where each plane includes a plurality of shaped charges. The shaped charges in one plane are rotated clockwise by an angle equal to half the phase angle between adjacent shaped charges in an adjacent plane. After this angular rotation has taken place, the distance between each of the adjacent planes of the perforating gun is reduced to a minimum (hereafter called "the minimum distance between adjacent planes"), and, as a result, the free space inside the loading tube of the perforating gun is reduced to a minimum. The minimum distance between adjacent planes is defined as follows: the minimum distance between adjacent planes is carefully selected such that (1) the number of shots from the shaped charges per foot in the perforating gun of the present invention when detonated (i.e., the shot density) is maximized, (2) when the perforating gun of the present invention is detonated, the amount of swell (i.e., the increase in diameter of the loading tube of the perforating gun) at selected places along the loading tube is significantly reduced, (3) the shaped charge case debris resultant from the detonation of the shaped charges is comprised of large chunks of debris, not small pieces of debris, and (4) the quantity of shaped charge debris in the perforating gun is also reduced relative to the quantity of such debris in prior art perforating guns. The quantity of shaped charge case debris following detonation of the perforating gun is decreased because the debris associated with each shaped charge in the gun is almost completely intact relative to its original condition. In addition, since the gun swell is decreased, a higher shot density perforating gun can be provided and the operator at the wellbore surface can successfully retrieve the higher shot density perforating gun through the casing or tubing to the surface of the wellbore.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 2, 3, and 4 illustrate the manner by which the shaped charges in one plane of the novel perforating gun are rotated relative to the shaped charges in an adjacent plane of the gun for the purpose of achieving the higher shot density relative to the shot density of prior art perforating guns.

FIG. 5 illustrates a sketch of a prior art perforating gun; and

FIG. 6 illustrates a sketch of the novel perforating gun of the present invention.

DETAILED DESCRIPTION OF THE PREFERRED EMBODIMENT

Figure 1:
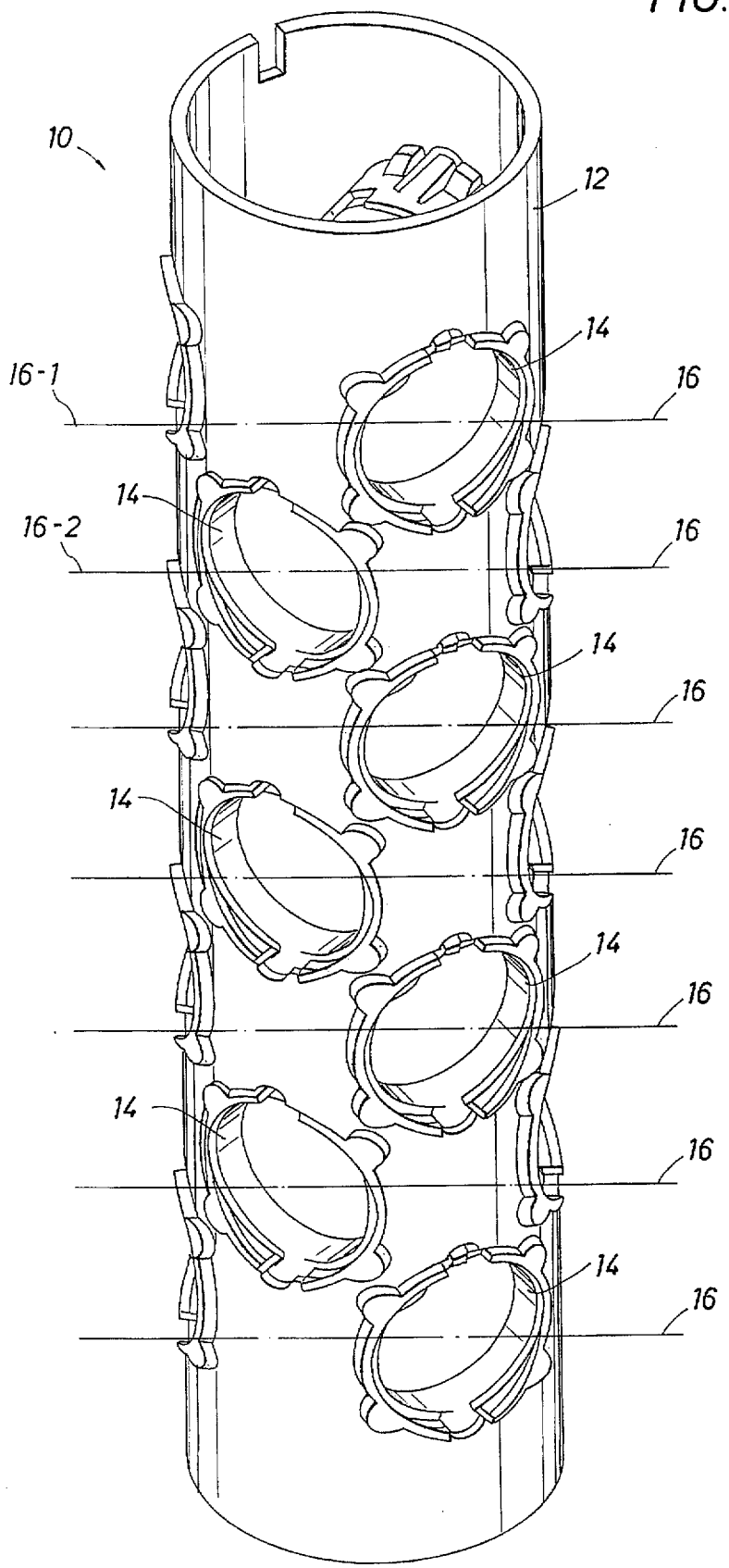
FIG. 1 illustrates a three dimensional view of the novel perforating gun of the present invention.

The perforating gun of the present invention includes a multiplicity of shaped charges, the multiplicity of shaped charges including a plurality of planes of charges, each plane of charges including a plurality (N) of shaped charges and a detonating cord running down through the axial center of each of the plurality of planes of charges. The plurality (N) of shaped charges are equally spaced at an angle 360/N about the detonating cord. Therefore, all of the shaped charges lying within each plane detonate at approximately the same time. In addition, the plurality of planes of charges: (1) are rotated at an angle of 180/N relative to one another, and (2) are packed so that the charges in one plane are nearly touching the charges in the adjacent plane, yet they all share the same centered detonating cord. The proximity of one plane to another is close enough such that one plane of charges detonates within a few microseconds of its neighboring plane of charges. The free space which exists between neighboring charges in the same plane and between neighboring charges on adjacent planes is nearly the same and, in both cases, such free space is very small. The close packing of the shaped charges in the same plane and between adjacent planes, and the resultant nearly simultaneous detonation of all the charges in the perforating gun: (1) prevent the charge cases from expanding significantly upon detonation, and (2) thereby prevent the charge cases from breaking up into numerous small pieces. As a result, the preferred embodiment of the perforating gun of the present invention yields a near-maximum packing density for a given cylindrical gun volume and gives rise to the following two unexpected properties:

(1) A reduced swelling of the gun's diameter after detonation because of the combination of near maximum packing density and symmetric detonation of the shaped charges—The close packing of the charges and near-simultaneous detonation prevents most of the charge case shrapnel from reaching the gun's inside wall, thereby decreasing the pressure loading that normally accompanies the detonation of a shaped charge. Rather than impacting the gun wall, most of the shrapnel impacts harmlessly on adjacent shaped charges.

(2) A significant reduction in the amount of shaped charge case debris that can escape from the perforating gun—The shaped charge case debris tends to get trapped in place, preventing the debris from expanding and subsequently breaking up into small particle debris. Most of the resulting debris is too large to escape from the exit holes in the perforating gun.

Alternatively, a filler could be placed between shaped charges to affect the same result. The filler acts to prevent the shaped charge case from breaking up into small pieces of shrapnel upon detonation, thus reducing the pressure loading on the inside surface of the gun. As a result, large pieces of shaped charge case debris is produced following detonation of the shaped charges.

The novel perforating gun of the present invention is designed in a manner which will maximize the shot density and minimize the free volume inside the perforating gun. In the preferred embodiment given by way of example only, the perforating gun of the present invention includes a plurality of planes of shaped charges, where each plane includes a plurality of shaped charges. The shaped charges in one plane are rotated clockwise by an angle equal to half the phase angle between adjacent shaped charges in an adjacent plane. After this angular rotation has taken place, the distance between each of the adjacent planes of the perforating gun is reduced to a minimum (hereafter called "the minimum distance between adjacent planes"). As a result, the free space which exists inside the loading tube of the perforating gun is reduced to a minimum. The minimum distance between adjacent planes is defined as follows: the minimum distance between adjacent planes is carefully selected such that (1) the number of shots from the shaped charges per foot in the perforating gun of the present invention when detonated (i.e., the shot density) is maximized, (2) when the perforating gun of the present invention is detonated, the amount of swell (i.e., the increase in diameter of the perforating gun) at selected places along the gun is significantly reduced, (3) the shaped charge case debris resultant from the detonation of the shaped charges is comprised of large chunks of debris, not small pieces of debris, and (4) the quantity of shaped charge debris that can escape from the perforating gun is also reduced relative to the quantity of such debris in prior art perforating guns. The quantity of shaped charge case debris following detonation of the perforating gun is decreased because the debris associated with each shaped charge in the gun is almost completely intact relative to its original condition. In addition, since the gun swell is decreased, a higher shot density perforating gun can be provided and the operator at the wellbore surface can successfully retrieve the higher shot density perforating gun through the casing or tubing to the surface of the wellbore.

Referring to FIG. 1, the novel perforating gun 10 of the present invention is illustrated.

In FIG. 1, the perforating gun 10 includes a loading tube 12 into which a plurality of shaped charges 14 are loaded or mounted. The perforating gun 10 includes a plurality of planes 16 which pass transversely through different parts of the perforating gun. In the preferred embodiment, which is given by way of example only and is not intended to be limitative of the present invention, each plane 16 passes through three (3) shaped charges 14 of the perforating gun 10. Stated differently, three shaped charges 14 lie within each plane 16 of the plurality of planes of the perforating gun 10. In the example, preferred embodiment of FIG. 1, seven (7) planes lie within each foot of the perforating gun. Since there are three shaped charges per plane, and there are seven planes per foot, the perforating gun of FIG. 1 has (3 times 7) or 21 shaped charges per foot. However, since a shaped charge, when detonated, produces a "shot", the "shot density" of the perforating gun of FIG. 1 is (3 times 7) or 21 shots per foot. Therefore, due to the unique structural characteristics of the perforating gun 10 shown by way of example in FIG. 1, the shot density of the perforating gun of FIG. 1 is very high, that is, 21 shots per foot.

The following paragraphs will describe the structure of the perforating gun 10 of the present invention and how this structure produces this high shot density figure.

Referring to FIGS. 2 and 3, one of the plurality of planes 16 is illustrated in FIG. 2 and the plane 16 which is disposed directly adjacent the plane 16 of FIG. 2 is further illustrated in FIG. 3.

Assume that the plane 16-1 illustrated in FIG. 2 is plane 16-1 of FIG. 1 and that the plane 16-2 illustrated in FIG. 3 is plane 16-2 of FIG. 1. In FIG. 2, the plane 16-1 includes shaped charges 14-1, 14-2, and 14-3, and the line of fire for each of the shaped charges 14-1 through 14-3 is illustrated by the arrows 1, 2, and 3. In FIG. 3, the plane 16-2 includes shaped charges 14-4, 14-5, and 14-6 and the line of fire for each of the shaped charges 14-4 through 14-6 is illustrated by arrows 1-1, 2-2, and 3-3. Assume further that the phase angle between each of the shaped charges 14-1, 14-2 and 14-3 in plane 16-1 of FIG. 2 is θ.

Referring to FIG. 3 with reference to FIG. 2, if the plane 16-1 in FIG. 2, which represents plane 16-1 of FIG. 1, is rotated clockwise by an angle equal to θ/2, where θ represents the phase angle between the charges 14-1 through 14-3 in plane 16-1, the resultant plane is shown in FIG. 3, which represents plane 16-2 of FIG. 1. In FIG. 2, the line of fire for shaped charges 14-2 through 14-3 is illustrated by arrows 1, 2, and 3. However, in FIG. 3, the line of fire for shaped charges 14-4 through 14-6 is illustrated by the arrows 1-1, 2-2, and 3-3. Therefore, plane 16-2 of FIGS. 1 and 3 represents a plane which has been rotated (or phased) clockwise by an amount equal to θ/2 relative to its previous plane 16-1, the previous plane 16-1 having a phase angle of θ between adjacent charges 14-1 through 14-3. In fact, each plane 16 of FIG. 1 is rotated or phased clockwise by an amount equal to θ/2 relative to its previous plane 16, where the phase angle between adjacent shaped charges in the previous plane 16 is equal to θ.

To illustrate more clearly the manner by which the charges 14 of one plane 16 in FIG. 1 are phased (or rotated) relative to the charges 14 of a previous, adjacent plane 16 in FIG. 1, refer to FIG. 4.

In FIG. 4, the line of fire for the charges 14-1 through 14-3 in FIG. 2 is represented by the solid arrows 1, 2, and 3; and the line of fire for the charges 14-4 through 14-6 in FIG. 3 is represented by the dotted arrows 1-1, 2-2, 3-3. Note that dotted arrows 1-1, 2-2, and 3-3 are rotated clockwise by an angular amount equal to θ/2 relative to the solid arrows 1, 2, and 3, where the phase angle between adjacent ones of the solid arrows 1, 2, and 3 is θ.

This simple illustration in FIG. 4 demonstrates that the shaped charges 14 in each successive plane 16 of FIG. 1 are angularly rotated or phased clockwise by an angle equal to θ/2 relative to the angular location of its previous, adjacent plane 16, where the phase angle between adjacent shaped charges in the previous, adjacent plane 16 is equal to θ.

The above paragraphs have addressed the relative phasing of each plane 16 of FIG. 1 with respect to its previous, adjacent plane 16. We know where the charges 14 of each plane 16 are angularly located along a circumference of the perforating gun 10 relative to a previous/adjacent plane, but we do not yet know where or how the charges 14 of each plane 16 are located along a longitudinal axis of the perforating gun 10.

The following paragraphs of this specification discuss the location of the planes 16 along a longitudinal axis of the perforating gun 10, that is, the density of the planes 16, in planes per foot, along a longitudinal axis of the perforating gun 10.

Referring to FIGS. 5 and 6, a sketch of a prior art perforating gun is illustrated in FIG. 5 and a sketch of the novel perforating gun of the present invention is illustrated in FIG. 6.

In FIG. 5, a simplified sketch of the prior art perforating gun 20 is illustrated. In FIG. 5, the perforating gun 20 included a plurality of planes 16 with a plurality of shaped charges in each plane, however, the prior art perforating gun 20 included three (3) planes per foot along the longitudinal axis of the perforating gun 20 with the plurality of shaped charges in each plane. The prior art also includes a perforating gun having a plurality of planes, there being five (5) planes per foot along the longitudinal axis of the perforating gun with the plurality of shaped charges in each plane.

However, referring to FIG. 6, the perforating gun 10 of the present invention, as shown in FIG. 1, also includes a plurality of planes 16. However, in FIG. 6, since the angular phasing method described above with reference to FIGS. 2–4 is being implemented, the planes 16 of shaped charges 14 of the perforating gun of the present invention shown in FIG. 6 can be more closely located or packed together relative to the planes 16 of prior art perforating gun of FIG. 5. Stated differently, after the angular phasing method of FIGS. 2–4 is implemented, the distance between each of the adjacent planes 16 of the perforating gun of FIG. 6 is reduced to a minimum (hereafter called "the minimum distance between adjacent planes"). As a result, the free space which exists inside the loading tube of the perforating gun of FIG. 6 is reduced to a minimum. The minimum distance between adjacent planes 16 of FIG. 6 is defined as follows: the minimum distance between adjacent planes is carefully selected such that (1) the number of shots from the shaped charges 14 per foot in the perforating gun of the present invention of FIG. 6, when detonated, (i.e., the shot density), is maximized and the free volume inside the gun is minimized, (2) when the perforating gun of the present invention of FIG. 6 is detonated, the amount of swell (i.e., the increase in diameter of the perforating gun) at selected places along the gun is significantly reduced relative to the swell of the loading tube of the perforating gun of FIG. 5, (3) the shaped charge case debris resultant from the detonation of the shaped charges 14 in FIG. 6 is comprised of large chunks of debris, not small pieces of debris found in the prior art perforating gun of FIG. 5, and (4) the quantity of shaped charge debris that can escape from the perforating gun of FIG. 6 is also reduced relative to the quantity of such debris found in the prior art perforating gun of FIG. 5.

In FIGS. 1 and 6, there are seven (7) planes 16 per foot along the longitudinal axis of the perforating gun 10, with a plurality of shaped charges 14 in each plane 16. In addition, however, as noted earlier, the shaped charges 14 in each successive plane 16 of FIGS. 1 and 6 are angularly rotated or phased clockwise by an angle equal to $\theta/2$ relative to the angular location or position of its previous, adjacent plane 16, where the phase angle between adjacent shaped charges in the previous, adjacent plane 16 is equal to $\theta$. With this particular packing arrangement, the number of planes of shaped charges per foot in the perforating gun with a plurality of charges per plane (i.e., the shot density) can be increased from the prior an three planes per foot, or from the prior an five planes per foot, to a total of seven (7) planes per foot. When there are 3 charges per plane, a higher shot density of 21 charges (or shots) per foot is produced, a higher shot density than was present in the prior art perforating gun. When this higher shot density in the novel perforating gun of the present invention is achieved, and when the perforating gun is detonated, the amount of swell (i.e., the increase in diameter) at selected places along the loading tube of the perforating gun is significantly decreased and the quantity of shaped charge debris in the perforating gun is also decreased. This decrease in the quantity of shaped charge debris following the detonation of the perforating gun of the present invention is achievable because the debris associated with each shaped charge in the gun is almost completely intact relative to its original condition. Since the gun swell is decreased, a higher shot density perforating gun can be provided and the operator at the wellbore surface can successfully retrieve the higher shot density perforating gun through the casing or tubing to the surface of the wellbore.

Another embodiment of the present invention would involve the placement of a filler between shaped charges to affect the same result. The filler acts to prevent the shaped charge case from breaking up into small pieces of shrapnel upon detonation, thus reducing the pressure loading on the inside surface of the gun. As a result, large pieces of shaped charge case debris is produced following detonation of the shaped charges.

In summary, by forming the array of capsule charges 14 in a perforating gun by angularly phasing the charges in the manner described above in FIGS. 2–4, and then reducing the distance between adjacent planes 16 to a minimum, until the charges 14 nearly touch one another, in the manner described above with reference to FIG. 6, it is possible to (1) pack higher amounts of explosive charges into the loading tube of the perforating gun without creating excessive swell in the gun housing when the charges are detonated, and (2) significantly reduce the amount or quantity of shaped charge debris left in the well following detonation. An acoustic explanation of this phenomenon is explained by the following principle: by solving a wave equation with two identical sources located at a distance d, the pressure field generated by these two sources is the same as the pressure field of a single source located at a distance d/2 from a fixed boundary. This principle is being utilized with the present invention first by mounting N number of shaped charges in a plane 16 at a phase angle "theta"=360/N, secondly by mounting the next row of charges in a next, adjacent plane 16 at a phase angle of "theta"/2, and thirdly by minimizing the distance between adjacent planes 16 until the charges 14 nearly touch one another, thereby minimizing the "free space" which exists within the loading tube of the peforating gun.

In addition, by using this high packing density of shaped charges in a perforating gun, it is possible to create an arrangement of deep penetrators that will increase the chances of intersecting natural fractures in a reservoir.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating gun including an outer wall, comprising:

a plurality of charges adapted to detonate, said outer wall of said perforating gun swelling following the detonation of said charges, each of said charges including a charge case, said plurality of charges including a first set of charges lying in a first plane and a second set of charges lying in a second plane, the first and second planes being separated from one another by a distance d, the first set of charges in the first plane and the second set of charges in the second plane each including m charges, adjacent ones of the charges in each plane having a phase angle θ, the second set of charges in the second plane being angularly phased by an angle equal to θ/2 relative to the first set of charges in the first plane, and the distance d between the first plane and the second plane being selected to be a minimum value, said minimum value of said distance d being selected such that, when said second set of charges in the second plane are phased by an angle equal to θ/2 relative to said first set of charges in the first plane and when said distance d is selected to be said minimum value and when said charges detonate, the charge cases of the first set of charges in the first plane and the second set of charges in the second plane remain substantially intact following the detonation of the charges and said swell of said outer wall of said perforating gun is substantially reduced.

2. The perforating gun of claim 1, wherein said perforating gun has a shot density, the number of the planes per foot along a longitudinal axis of said perforating gun being equal to "n", the number of said first set of charges in said first plane being equal to "m" and the number of said second set of charges in said second plane being equal to "m", said shot density being equal to "n" multiplied "m".

3. The perforating gun of claim 2, wherein said number of the planes per foot along said longitudinal axis of said perforating gun is equal to seven (7) planes per foot.

4. In a perforating gun including an outer loading tube and a plurality of shaped charges mounted inside said loading tube of said perforating gun, said plurality of shaped charges being adapted to detonate and each of the charges include a charge case, said plurality of shaped charges including a first plurality of charges and a second plurality of charges, said perforating gun having a shot density, said outer loading tube of said perforating gun swelling when said charges detonate, a method of packing said plurality of shaped charges in said loading tube of said perforating gun, comprising the steps of:

arranging said first plurality of charges in a first plane and arranging said second plurality of charges in a second plane, the first plurality of charges in the first plane including a first charge and the second plurality of charges in the second plane including a second charge which corresponds to the first charge in the first plane;

angularly locating the second charge of the second plurality of charges of the second plane by an angle equal to θ/2 relative to the first charge of the first plurality of charges of the first plane, a phase angle between each of the adjacent ones of the first plurality of charges in the first plane being equal to an angle θ; and longitudinally locating said plurality of shaped charges in said outer loading tube along a longitudinal axis of said perforating gun such that said shot density of said plurality of shaped charges in said loading tube of said perforating gun is a maximum value, said maximum value of said shot density being selected such that, when the second charge of the second plurality of charges of the second plane is angularly located by an angle equal to θ/2 relative to the first charge of the first plurality of charges of the first plane and when said shot density is said maximum value and when said charges detonate, the charge cases of said plurality of charges remain substantially intact and said swell of said outer loading tube of said perforating gun is substantially reduced following the detonation of the plurality of charges.

5. The method of claim 4, wherein the number of said first plurality of charges and the number of said second plurality of charges are each equal to "n", said shot density in units of shots per foot being equal to the number of the planes per foot multiplied by "n".

6. The method of claim 5, wherein said number of the planes per foot is equal to seven (7) planes per foot.

7. A perforating gun, comprising:

an outer loading tube having a longitudinal axis;

a plurality of charges disposed within said outer loading tube and adapted to detonate, said plurality of charges including a first plurality of charges lying in one plane along said longitudinal axis of said loading tube and a second plurality of charges lying in a previous adjacent plane along said longitudinal axis of said loading tube;

said outer loading tube swelling when said plurality of charges in said loading tube detonate, said first plurality of charges in said one plane being angularly phased by an angular amount equal to θ/2 relative to said second plurality of charges in said previous adjacent plane, adjacent ones of said second plurality of charges in said previous adjacent plane having a phase angle θ, the planes along said longitudinal axis of said loading tube in said perforating gun being longitudinally located for producing a density of said planes, said density of said planes having units of planes per foot along said longitudinal axis, said planes per foot along said longitudinal axis being selected to be a maximum value, said maximum value of said planes per foot being selected such that, when said first plurality of charges in said one plane is angularly located by said angular amount equal to θ/2 relative to said second plurality of charges in said previous adjacent plane and when said planes per foot is selected to be said maximum value and when said charges detonate, the charge cases of said plurality of charges will remain substantially intact and said swell of said outer loading tube of said perforating gun will be substantially reduced in response to the detonation of said plurality of charges.

8. The perforating gun of claim 7, wherein said planes per foot of said density is equal to seven (7) planes per foot.

* * * * *